US006283603B1

(12) United States Patent
Lin

(10) Patent No.: US 6,283,603 B1
(45) Date of Patent: Sep. 4, 2001

(54) LIGHTING DEVICE ON A STAGE

(75) Inventor: Yu-Chuan Lin, San Chung (TW)

(73) Assignee: Superstar Lighting Company Limited, Taipei Hsien (TW)

( * ) Notice: Subject to any disclaimer, the term of this patent is extended or adjusted under 35 U.S.C. 154(b) by 0 days.

(21) Appl. No.: 09/559,585

(22) Filed: Apr. 28, 2000

(51) Int. Cl.[7] ..... F21V 21/30
(52) U.S. Cl. ..... 362/35; 362/286; 362/287
(58) Field of Search ..... 362/35, 287, 250, 362/419, 286, 422, 423, 424, 425, 293, 294

(56) References Cited

U.S. PATENT DOCUMENTS 4,353,110 * 10/1982 Ellis ..... 362/35
5,084,803 * 1/1992 Lan ..... 362/35
5,091,828 * 2/1992 Jincks et al. ..... 362/35
5,269,719 * 12/1993 Klawitter et al. ..... 362/35
5,842,768 * 12/1998 Menke ..... 362/286

* cited by examiner

*Primary Examiner*—Thomas M. Sember
(74) *Attorney, Agent, or Firm*—Dougherty & Troxell

(57) ABSTRACT

A lighting device is composed of a case, a driving device, a power source contacting device, a power source rotary device, an actuating arm, and at least a light ball. When the power source is turned on to light up the lighting device, the motor of the driving device starts to rotate the rotary device and the actuating arm synchronously. Accordingly, the lighting ball is rotated horizontally. In addition, a gear disk of the light ball rolls along a gear ring on the case such that the light ball can rotate vertically as well.

13 Claims, 6 Drawing Sheets

LIGHTING DEVICE ON A STAGE

BACKGROUND OF THE INVENTION

1. Field of the Invention:

The present invention relates to a lighting device employed on a stage, and particularly to a lighting device, which provides a single motor to rotate at least a light ball to save occupied space and has easily assembled parts to meet the need of home audio amusement and family budget.

2. Description of Related Art:

The development of lighting on a stage becomes getting complicated due to the performing arts being getting compact. Generally, the lighting accompanying with changeable sound can enhance the air on the stage such that the performance on the stage can be brought into a climax accordingly. Therefore, the lighting design is an extremely important part especially in designing a stage.

However, it is known that a single rotating light on a stage is not possible to create a cheering mood such that the air on the stage can not be controlled very well. That is why lighting devices have to be mounted at the ceiling above the stage, attached to the wall nearby the stage, and laid on the stage. Hence, it appears a phenomenon that there are a lot of lights around the area of a stage. But, too many lights around a stage not only break the integral beauty sense of the stage but also occupy too much space around the stage such that the area for performing a play becomes less substantially. Moreover, it has to be mentioned that to fix so many lights for the stage is really a tedious job.

In order to overcome the disadvantage of conventional lighting arrangement on a stage, there is a driver designed to rotate two light balls simultaneously. The driver mainly comprises a casing and a principal motor in the casing. A transmission shaft of the principal motor pivotally connects with a transverse actuation arm. Both ends of the arm further provide a secondary motor respectively to associate with a light ball. When the principal motor is started, the light balls rotate horizontally on the actuation arm. Then, the secondary motors are started afterward to rotate the light balls vertically either. Although the driver is capable of reducing the number of lights on a stage and increasing the space available for performing a play definitely, three motors have to be operated lead that not only the production cost is higher but also the entire volume is greater. Furthermore, it is not easy for an operator to take care of more switches for the motors.

Moreover, the home audio appliance is getting popular for home amusement. But, the original lighting arrangement designed in a family house is unable to create a cheering air as the stage does. Of course, the traditional lighting device on a stage is usually employed in a dancing hall and a vocal concert. Nevertheless, it is not appropriate for a family house to employ the lighting device used on a stage because of its high cost and huge volume.

SUMMARY OF THE INVENTION

An object of the present invention is to provide a lighting device on a stage, in which only a single motor is used for rotating at least a light ball synchronously so as to reduce the space occupied by the lighting device.

Another object of the present invention is to provide a lighting device on a stage, in which a simpler structure with less parts is designed to lower the production cost.

A further object of the present invention is to provide a lighting device on a stage, in which the parts thereof are easily assembled and disassembled to save the labor hours to fix the entire lighting device.

BRIEF DESCRIPTION OF THE DRAWINGS

The present invention can be more fully understood by referring to the following description and accompanying drawing, in which.

DETAILED DESCRIPTION OF THE PREFERRED EMBODIMENTS

Figure 1:
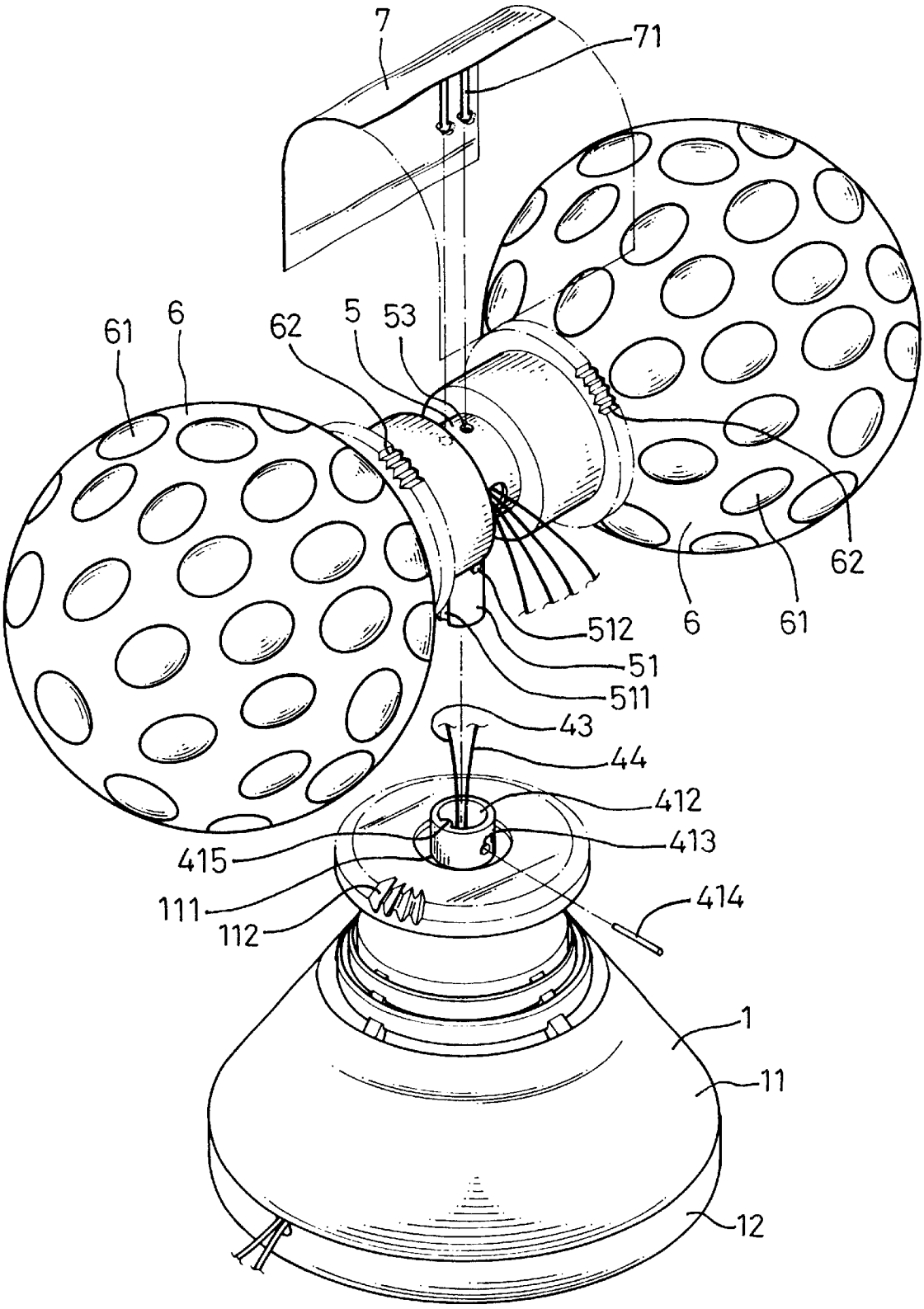
FIG. 1 is a disassembled perspective view of a lighting device in accordance with the present invention.
Figure 2:
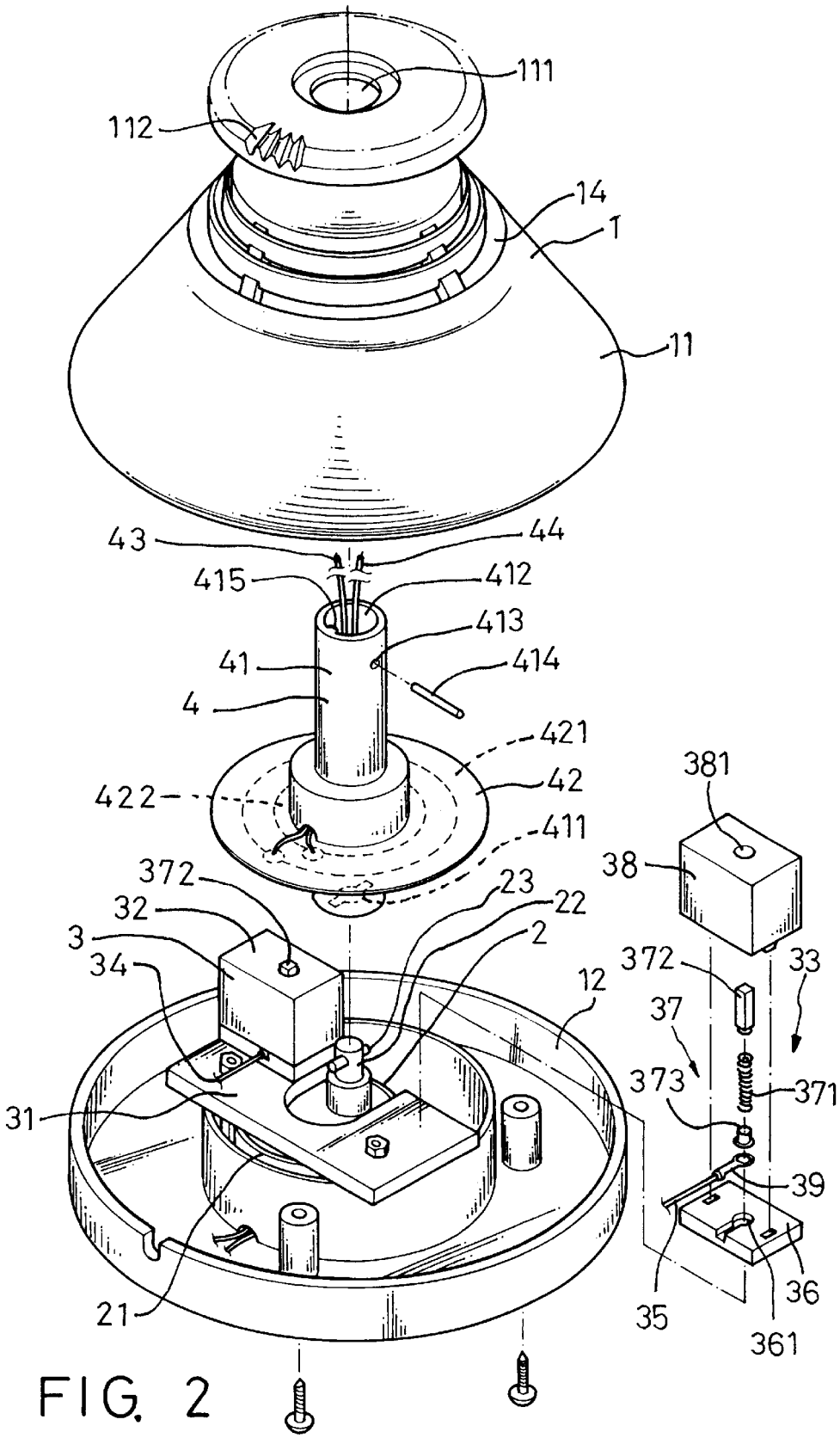
FIG. 2 is an exploded perspective view of a case, a power source rotary device, and a power source contacting device shown in FIG. 1.
Figure 3:
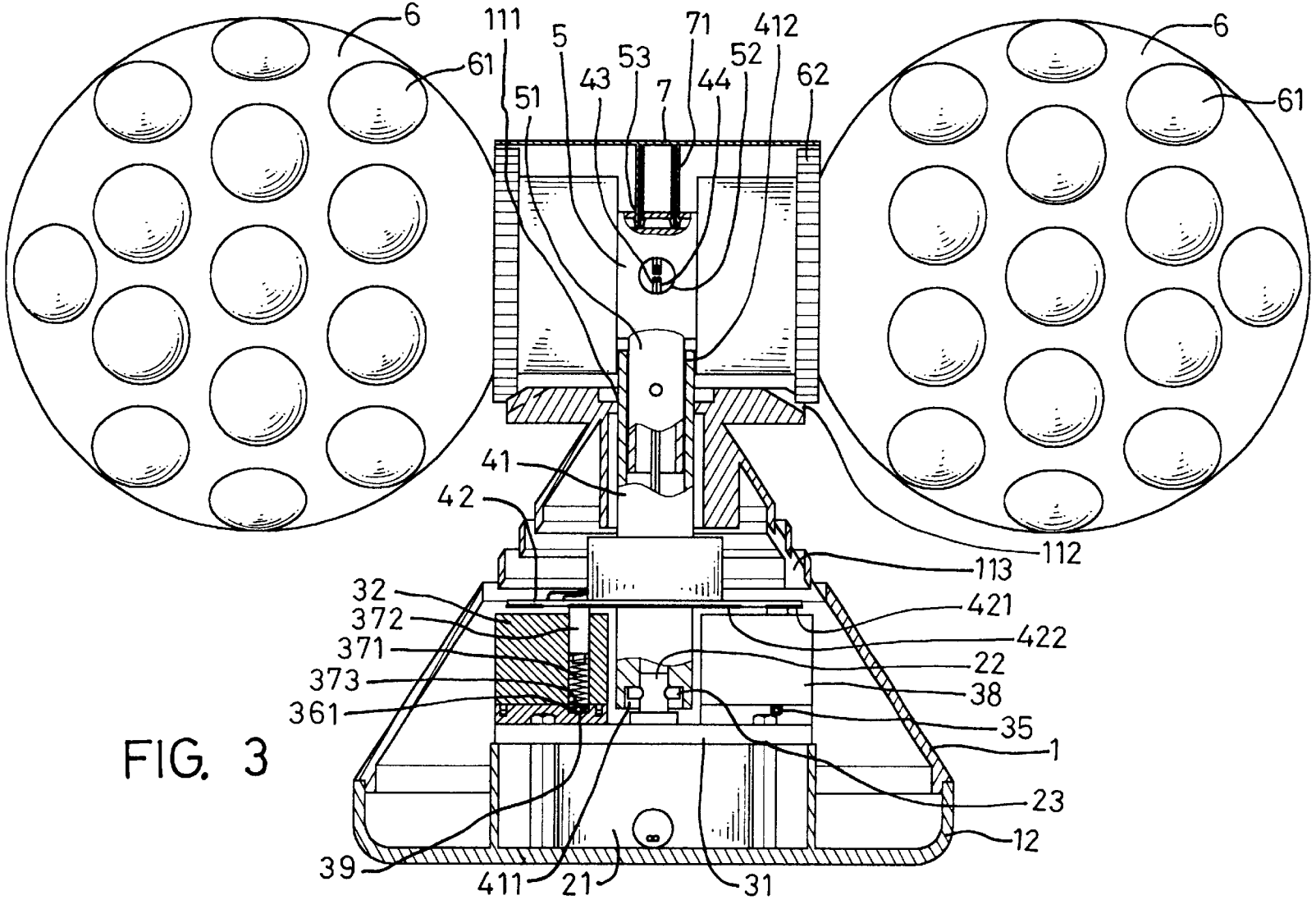
FIG. 3 is a sectional view of the lighting device in FIG. 1 in an assembled state.
Figure 4:
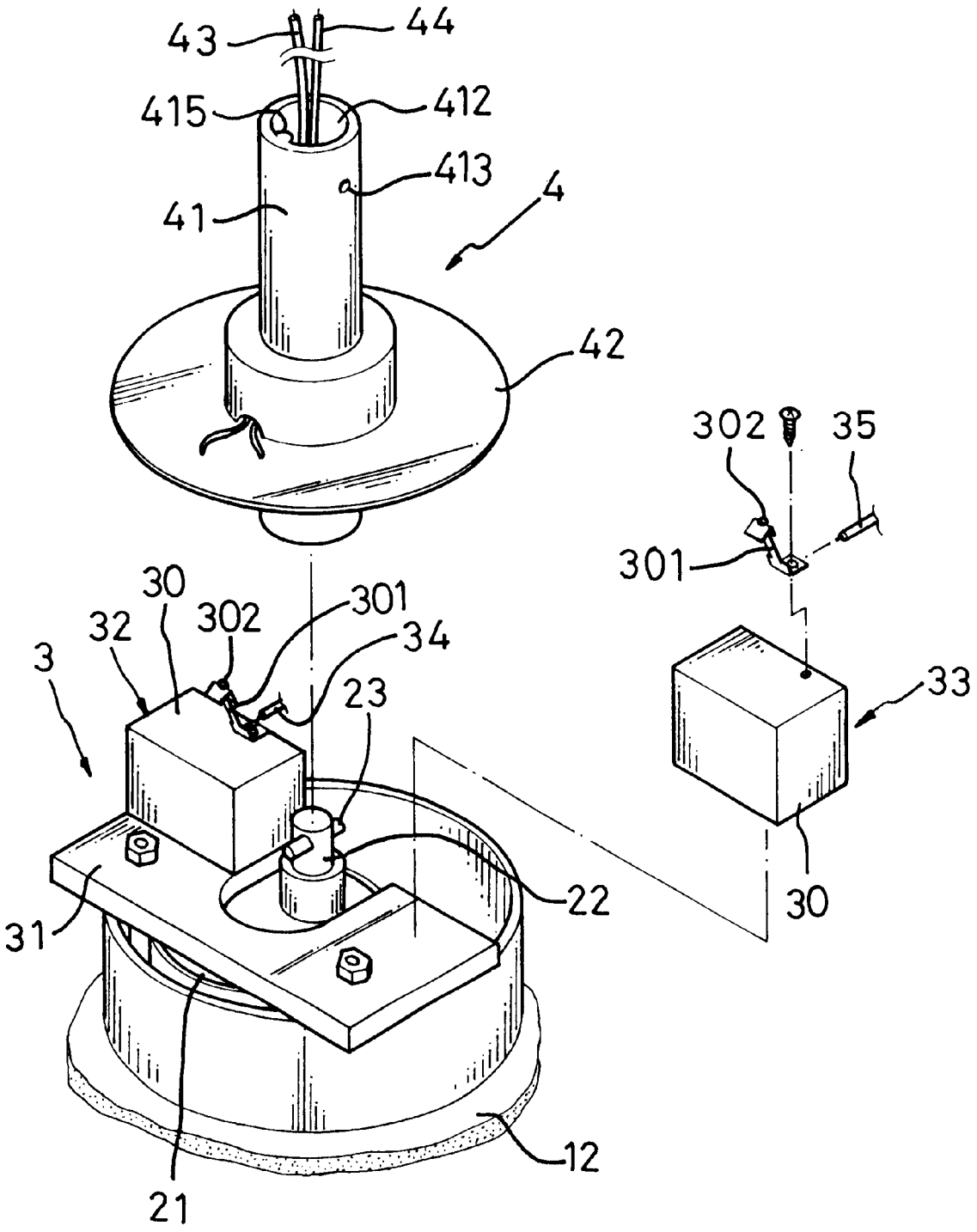
FIG. 4 is a perspective view of the power source contacting device in another embodiment.

Referring to FIGS. 1 through 4, basically, a lighting device of the present invention comprises a case 1, a driving device 2, a power source contacting device 3, a power source rotary device 4, an acting arm 5, and at least a light ball 6.

The case 1 consists of an upper case part 11 and a lower case part 12. Both the case parts 11, 12 fits with each other to provide a room therein for receiving the driving device 2, the power source contacting device 3, and the power source rotary device 4. The upper case part 11 at the top face thereof has a central shaft hole 111 and a facial gear ring 112 surrounding the periphery of the top face. Besides, the upper case part 11 at the inner wall thereof provides several ring blocks or a ring block 113 (see FIG. 3) to hold an insulating disk 42 in case of inversely fixing the light device. Furthermore, the upper case part 11 surrounding the outer surface thereof has several ring grooves 114 to ease the heat dissipation generated from the driving device 2. The lower case part 12 therein provides several projections and engaging holes for fastening the driving device 2 and the power source contacting device 3 thereto by way of conventional fasteners such as screws.

The driving device 2 is a motor 21 fixedly attached to the lower case part 12 and the motor 21 has an output shaft 22 extending outward to pivotally connect with the power source rotary device 4. Besides, the output shaft 22 is inserted an engaging pin 23 laterally.

The power source contacting device 3 is fixed above the motor 21 and has a base plate 31 with a first and a second contact electrodes 32, 33 at both sides thereof respectively. The contact electrodes 32, 33 pivotally connect with a first and a second leads 34, 35 respectively so as to supply the electricity to the rotary device 4. In order to assure the first and the second electrodes 32, 33 keeping contact with the contacting device 3, each contact electrode provides an insulating bottom plate 36. The insulating bottom plate 36 has an engaging groove 361 thereon to receive and locate a conductive terminal 39 for connecting a lead wire. A power source extendable device 37 is placed in a through hole 381 of an insulating shield cover 38. Finally, the shield cover 38 engages with the bottom plate 36 by way of locking pieces or screws so as to keep a conductive button 373 contacting with the conductive terminal 39. Another end is an electrode terminal 372 exposing outward the top of the shield cover 38 such that an electric connection between the power source and the contact electrode can be obtained successfully. The power source extendable device 37 has a spring 371 and an end of the spring 371 fits with the electrode terminal 372 and the other end of the spring 371 fits with the conductive button 373.

Figure 5:
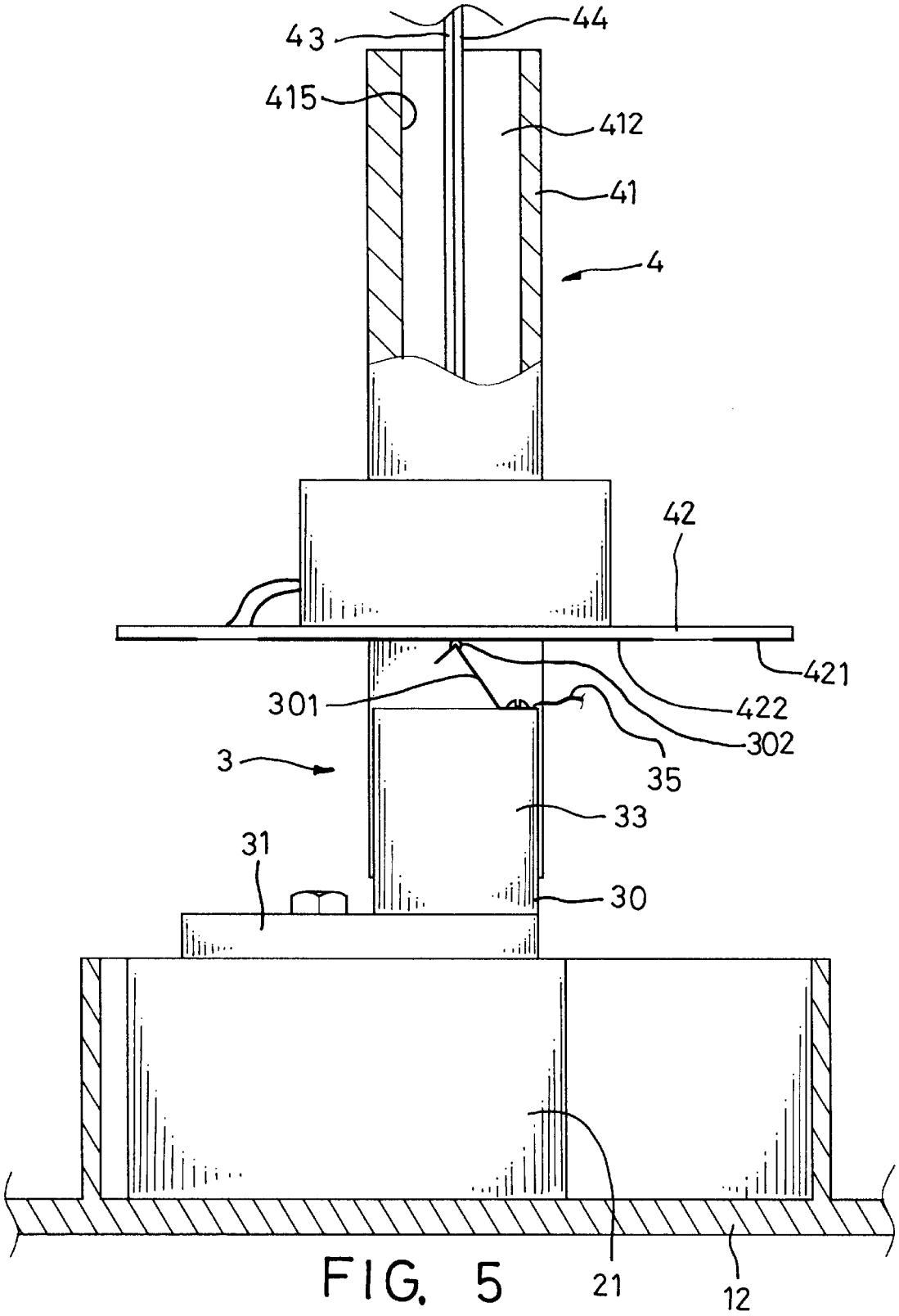
FIG. 5 is a sectional view of the power source contacting device shown in FIG. 4 in an assembled state.
Figure 6:
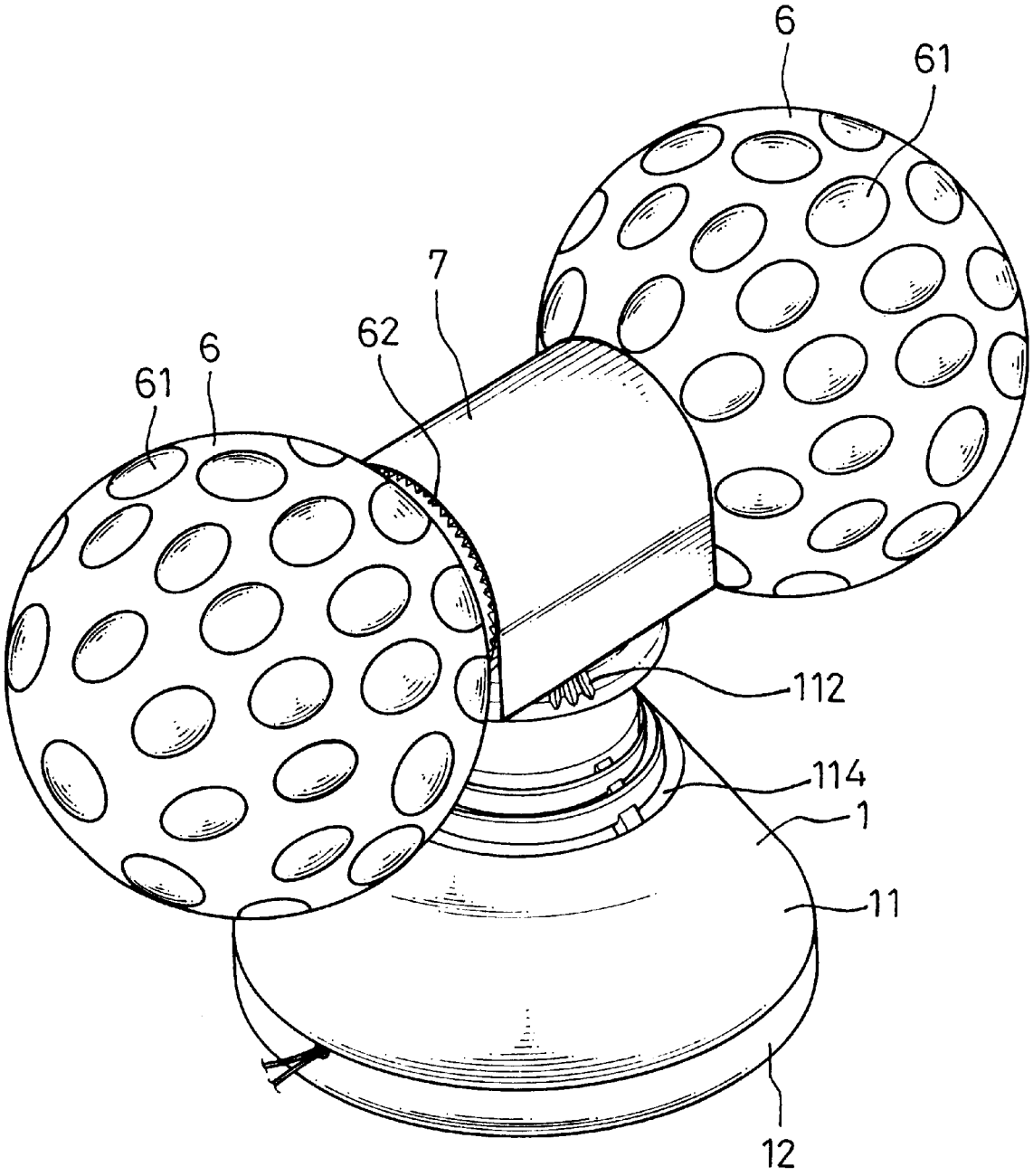
FIG. 6 is an assembled perspective view of a lighting device in accordance with the present invention.

Referring to FIG. 5 and making reference to FIG. 4 again, the power source contacting device 3 in another embodiment is illustrated. The base plate 31 at both sides thereof has a first and a second electrodes 32, 33 and both the contact electrode have a base 30 respectively. The base 30 at the top thereof engages with a conductive leaf spring of multiple bends 301. The leaf spring 301 at the lower end thereof connects with a lead wire (one of lead wires 34, 35) and the upper end thereof is an electrode terminal 302 to contact with a first guide ring or a second guide ring 421, 422 to form a close circuit. Besides, the electrode terminal 302 on the leaf spring 301 has a circular bend so as to point-contact with the guide ring and a phenomenon of interference can be avoided.

The power source rotary device 4 has a rotary shaft 41 and the rotary shaft 41 at the lower end thereof is provided with an engaging recession 411 to fit astride with the engaging pin 23 on the output shaft 22. The rotary shaft 41 at the upper portion thereof is provided with a shaft groove 412 and a lateral through hole 413. The through hole 413 communicates the shaft groove 412 and is inserted by an engaging pin 414 to engage the rotary shaft 41 with the actuating arm 5 to form an engaging coupling between the rotary shaft 41 and the actuating arm 5 while in motion. The shaft groove 412 on the rotary shaft 41 has an inner rib 415 and at the lower portion thereof is provided with another insulating disk 42. The insulating disk 42 at the bottom surface thereof has a first guide ring and a second guide ring 421, 422 with different diameters to correspond to the first and the second electrodes 32, 33 respectively. Therefore, the guide rings 421, 422 can contact with the contact electrodes 32, 33 respectively. A third and a fourth lead wires 43, 44 at an end thereof respectively are brazed to attach the first and the second guide rings 421, 422 correspondingly and at the other end thereof pass through the shaft groove 412.

The actuating arm 5 has a shape of letter "T" and at the lower portion thereof is an arm stem 51 inserting into the shaft groove 412 of the rotary shaft 41 so that the actuating arm 5 can be moved with the rotary shaft 41. An outer groove 511 on the actuating arm 5 is provided to fit with the inner rib 415 and an engaging hole 512 is also provided on the actuating arm 5 to correspond to the through hole 413 so as to be passed through by the engaging pin 413. Thus, the actuating arm 5 can be associated with the rotary shaft 41 and rotates synchronously with the rotary shaft 41. Besides, the actuating arm 5 has a guide hole 52 to allow two current-leads from the power source of the light balls 6 passing through for connecting with the third and the fourth lead wires 43, 44. Furthermore, the actuating arm 5 at the top thereof may provide a locating hole 53 to fit with an engaging projection 71 of a cover 7 so as to conceal the related current-leads and lead wires.

The light ball 6 is located at a lateral side of the actuating arm 5 and a light bulb with two current-leads are disposed therein to connect with the third and the fourth lead wires 43, 44. The light ball 6 on the outer surface thereof has a plurality of transparent different color spots 61 for creating a changeable lighting effect. The light ball 6 at an engaging end thereof has a gear disk 62 to mesh with the gear ring 112 on the case 1 such that the light ball 6 can roll vertically along the gear ring 112 and rotate horizontally with the actuating arm 5 as well. In practice, it is preferable that both sides of the actuating arm 5 are disposed with a light ball 6 respectively.

The operation of the lighting device on a stage in accordance with the present invention will be described hereinafter. When the power source is turned on, the output shaft 22 of the motor 21 can rotate the rotating shaft 41 and the insulating disk 42 synchronously. At this time, the first and second guide rings 421, 422 at the bottom of the insulating disk 42 keep contact with the electrode terminals 372 on the first and second contact electrodes 32, 33 respectively. Hence, the power is transmitted to the two light balls 6 through the third and fourth lead wires so as to turn on the light bulb in the light balls 6. In this way, the actuating arm 5 associated with light balls 6 rotates horizontally and the light balls 6 roll vertically by way of the gear disks 62 rotating along the gear ring 112. Therefore, the light balls 6 can present multiple rotational modes such that a changeable lighting on a stage is possible to reach and to enhance a sense of beauty.

It is noted that the current leads above the insulating disk rotates synchronously with the rotating shaft and it is not possible for the current leads to wind up or tangle with each other. It is appreciated that only a motor is applied to rotate two light balls and a cheaper production cost can be obtained advantageously. In addition, most parts are engaged with each other by way of sleeve connection or scarf joint in addition to few parts fastened by way of screws such that less assembling labor hours are needed. Moreover, it is possible for the lighting device of the present invention to be disassembled as shown in FIG. 1 and the disassembled parts can be packaged separately for delivery to save a lot of gross space and the transportation cost accordingly. Furthermore, the lighting device of the present invention is simple in construct and can be assembled by DIY such that it is quite appropriate for the need of audio amusement in a family house and for the budget of an ordinary family. Finally, it is noted that the respective power source in the two contact electrodes in the lighting device of the present invention always keep contact with the first and the second guide rings in case of the lighting device being mounted in a reverse position. Hence, it is not possible to result in a phenomenon of non-lightened light bulb.

While the invention has been described with reference to a preferred embodiment thereof, it is to be understood that modifications or variations may be easily made without departing from the spirit of this invention, which is defined by the appended claims.

What is claimed is:

1. A lighting device on a stage, comprising a case, having an upper case part and a lower case part engaging with each other, and a top face of the upper case having a central shaft hole and having a facial gear ring surrounding the periphery thereof;

a driving device, being a motor fixedly mounted on the lower case part with an output shaft extending outward;

a power source contacting device, having a base plate astride above the motor, the base plate at both sides thereof being disposed with a first contact electrode and a second electrode respectively, said first and second electrodes at the bottom thereof respectively pivotally engaging with a first lead wire and a second lead wire of power supply, and at the top thereof respectively having an exposed electrode terminal respectively;

a power source rotary device, having a rotary shaft being associated with and moving with the output shaft, the rotary shaft at an end portion having a shaft recession and around the other end portion thereof having an insulating disk, the insulating disk at a bottom face thereof having a first guide ring and a second guide ring with unequal diameters corresponding to the two terminals respectively so as to contact with the terminals, both the guide rings contacting with a third lead wire and a fourth lead wire at an end thereof respectively, and the other end of the third and fourth lead wires passing through the shaft groove respectively;

an actuating arm, being "T" shape, having an arm stem at a lower part thereof associated with the rotary shaft, and having a guide hole for current leads at an upper part thereof;

at least a light ball, being disposed at an end of the actuating arm, having a light bulb and two current leads therein, said two current leads passing through the guide hole and pivotally connecting with the third and the fourth lead wires respectively to constitute a closed circuit, and having an engaging end with a gear disk to correspond to and to mesh with the gear ring on the case vertically;

whereby, at the time of the light ball being turned on, the motor turns to rotate the power source rotary device and the actuating arm synchronously so as to rotate the light ball horizontally; and the gear disk on the light ball rolls along the gear ring to make the light ball rotate vertically.

2. The lighting device on a stage as defined in claim 1, wherein the upper case part at an inner wall thereof may extend a ring block or a plurality of ring blocks to hold the insulating disk in case of the lighting device being arranged in a reversed position.

3. The lighting device on a stage as defined in claim 1, wherein the upper case part around a surface thereof may be provided with a plurality of ring grooves for dissipating heat.

4. The lighting device on a stage as defined in claim 1, wherein the output shaft on the motor is inserted laterally an engaging pin and the rotary shaft at a lower portion thereof is provided with an engaging groove to fit with the engaging pin to form a rotating coupling.

5. The lighting device on a stage as defined in claim 1, wherein the contact electrode comprises a bottom plate with an engaging groove thereon to receive and locate a conductive terminal for a lead wire, a shield cover with a through hole, a power source extendable device placed in the through hole of the shield cover such that an end of the extendable device contacts with the conductive terminal, and the electrode terminal extends outside the shield cover.

6. The lighting device on a stage as defined in claim 5, wherein the power source extendable device has a spring and an end thereof sleeves with the electrode terminal and the other end thereof sleeves with a conductive button.

7. The lighting device on a stage as defined in claim 1, wherein the contact electrode comprises a base, and a conductive leaf spring with multiple bends associated with the base; the conductive leaf spring at an end thereof connects with a lead wire and at the other end thereof provides an electrode terminal.

8. The lighting device on a stage as defined in claim 7, wherein the electrode terminal is a bend of circular shape.

9. The lighting device on a stage as defined in claim 1, wherein the rotary shaft has a lateral engaging hole and the arm stem has a corresponding engaging hole to be engaged by a engaging pin so as to associate the rotary shaft with the arm stem.

10. The lighting device on a stage as defined in claim 9, wherein the shaft groove of the rotary shaft provides a shaft rib and the arm stem provides a corresponding engaging groove to fit with each other so as to align the engaging holes on the arm stem and the rotary shaft respectively for easing inserting the engaging pin.

11. The lighting device on a stage as defined in claim 1, wherein the light ball on the surface thereof may provide a plurality of different color spots.

12. The lighting device on a stage as defined in claim 1, wherein an upper cover may be disposed above the actuating arm to conceal the lead wires and the current leads.

13. The lighting device on a stage as defined in claim 12, wherein the actuating arm at top thereof may provide a locating hole or more locating holes to fit with a downward engaging projection or more downward engaging projections on the upper cover.

* * * * *